US007748796B2

(12) United States Patent
Rockwell et al.

(10) Patent No.: US 7,748,796 B2
(45) Date of Patent: Jul. 6, 2010

(54) COMPOSITE TUB BODY FOR A DISHWASHER

(75) Inventors: Anthony L. Rockwell, Pickerington, OH (US); Phil Johnson, Louisville, KY (US); Charles F. Pratt, Granville, OH (US)

(73) Assignee: OCV Intellectual Capital, LLC DE (US)

( * ) Notice: Subject to any disclaimer, the term of this patent is extended or adjusted under 35 U.S.C. 154(b) by 0 days.

(21) Appl. No.: 12/124,205

(22) Filed: May 21, 2008

(65) Prior Publication Data

US 2008/0290770 A1 Nov. 27, 2008

Related U.S. Application Data

(60) Provisional application No. 60/931,659, filed on May 24, 2007.

(51) Int. Cl.
*A47B 77/08* (2006.01)

(52) U.S. Cl. ..... 312/228

(58) Field of Classification Search ..... 312/257.1, 312/228, 228.1, 229, 311, 276, 265.5; 134/200, 134/201

See application file for complete search history.

(56) References Cited

U.S. PATENT DOCUMENTS

| | | | | |
|---|---|---|---|---|
| 3,167,159 A | | 1/1965 | Bovenkerk | |
| 3,295,541 A | * | 1/1967 | Ummel | 134/182 |
| 4,098,545 A | * | 7/1978 | Gaiser et al. | 312/228 |
| 5,044,705 A | * | 9/1991 | Nelson | 312/228 |
| 5,368,379 A | * | 11/1994 | Wrangberth | 312/228 |
| 5,992,954 A | * | 11/1999 | Becker | 312/228 |

FOREIGN PATENT DOCUMENTS

| | | |
|---|---|---|
| DE | 44 43 919 | 6/1996 |
| EP | 1 733 674 | 12/2006 |
| GB | 1 244 522 | 9/1971 |
| WO | WO 02/053009 | 7/2002 |
| WO | WO 2005/034715 | 4/2005 |
| WO | WO 2006/010743 | 2/2006 |

OTHER PUBLICATIONS

International Search Report PCT/US2008/064282 Dated Sep. 2, 2008.

* cited by examiner

*Primary Examiner*—James O Hansen
(74) *Attorney, Agent, or Firm*—James J. Dottavio; Kathryn W. Grant

(57) ABSTRACT

A dishwasher tub includes a main body having opposing side walls that are interconnected by a rear wall, all formed from a multi-layered composite material. A cap member is joined atop the opposing side and rear walls, a base member is joined to lower edge portions of the opposing side walls and rear wall, and a frontal halo member is mounted between the cap and base member to define an overall washing chamber having a front opening. Preferably, the multi-layered composite material includes an inner stainless layer, a rigid layer and an outer protective layer, such as a layer of stainless steel, a rigid polyester mat, and a protective layer of hard plastic or aluminum foil. The outer layer also preferably serves as a shipping container for the dishwasher, enabling components of the dishwasher to be transported to a designated location for final assembly.

11 Claims, 3 Drawing Sheets

COMPOSITE TUB BODY FOR A DISHWASHER

CROSS-REFERENCE TO RELATED APPLICATIONS

The present application claims the benefit of U.S. Provisional Patent Application Ser. No. 60/931,659 entitled "Composite Tub Body for a Dishwasher" filed May 24, 2007.

BACKGROUND OF THE INVENTION

1. Field of the Invention

The present invention pertains to the art of dishwashers and, more particularly, to a dishwasher tub body formed from a multi-layer composite structure.

2. Discussion of the Prior Art

A typical dishwasher includes a tub having a front opening that leads to an interior washing compartment and a door that pivotally mounts, in a sealable manner, across the front opening. Dishwasher tubs are typically formed from reinforced molded plastic having an inner surface provided with a finish that is resistant to food stains. However, through exposure to certain foods over time, the inner surface can become discolored. In higher end dishwasher models, the tub is formed from stamped and welded stainless steel which is more impervious to stains.

Stamped and welded stainless steel tubs currently employed in the dishwasher industry are formed from a fairly heavy gauge (0.22-0.26 inches; 5.59-6.60 mm) stainless steel material. The stainless steel material is stamped into shape using very expensive metal stamping equipment. The tub is formed in two parts which then must be both welded and crimped to achieve a water tight enclosure. The stamping machinery includes a specific mold that forms a particular tub half with each operation. Stamping, welding and crimping the components, coupled with the need to change stamping molds for each dishwasher model, is a costly and time consuming process.

In addition to serving as the washing compartment stainless steel tubs provide structural support for the dishwasher, thus the requirement for the heavy gauge stainless steel. However, stainless steel tubs must also be provided with support ribs and an exterior coating of a mastic material which acts both as a sound deadening and insulation layer. The need for heavy gauge steel, ribs and the requirement of the mastic layer further increases costs associated with the manufacturing process.

In connection with the present invention, a need has been recognized for a stain resistant dishwasher tub that is both easy to manufacture and modular. The tub would also provide any necessary sound/thermal insulation and structural support for the appliance.

SUMMARY OF THE INVENTION

The present invention is directed to a tub for a dishwasher. The dishwasher tub includes a main body having first and second opposing side walls that are interconnected by a rear wall. Each of the first and second opposing side walls and rear wall include corresponding upper and lower edge portions. In accordance with the invention, the opposing side and rear walls are formed from a multi-layered composite material. In accordance with a first embodiment of the invention, the main body is preferably formed from a single sheet of composite material that is folded into shape. In accordance with a second embodiment of the invention, each of the first and second opposing side walls and rear wall can also be formed separately and joined together to form the main body. In addition, the dishwasher tub includes a cap member joined to the upper edge portions of the opposing side and rear walls, as well as a base member joined to the lower edge portion of each of the first and second opposing side walls and rear wall. The main body, coupled with the cap and base members, define an overall washing chamber having a front opening.

Preferably, the multi-layered composite material includes a stainless layer, a rigid layer and a protective layer. More specifically, the stainless layer is preferably formed from thin (0.05-0.08 inches; 1.27-2.03 mm) gauge stainless steel and defines an interior surface of the tub. The rigid layer is preferably formed from a polyester mat most preferably VERSA-MAT® produced by Owens Corning, which provides both structural integrity and sound insulation for the tub. The outer, protective, layer is formed from hard plastic, aluminum foil or the like. The outer layer, in addition to adding to the overall structural support of the tub, also preferably serves, at least in part, as a shipping container for the dishwasher. In this manner, components of the dishwasher can be constructed in various locations then readily and inexpensively transported to a control location for final assembly.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
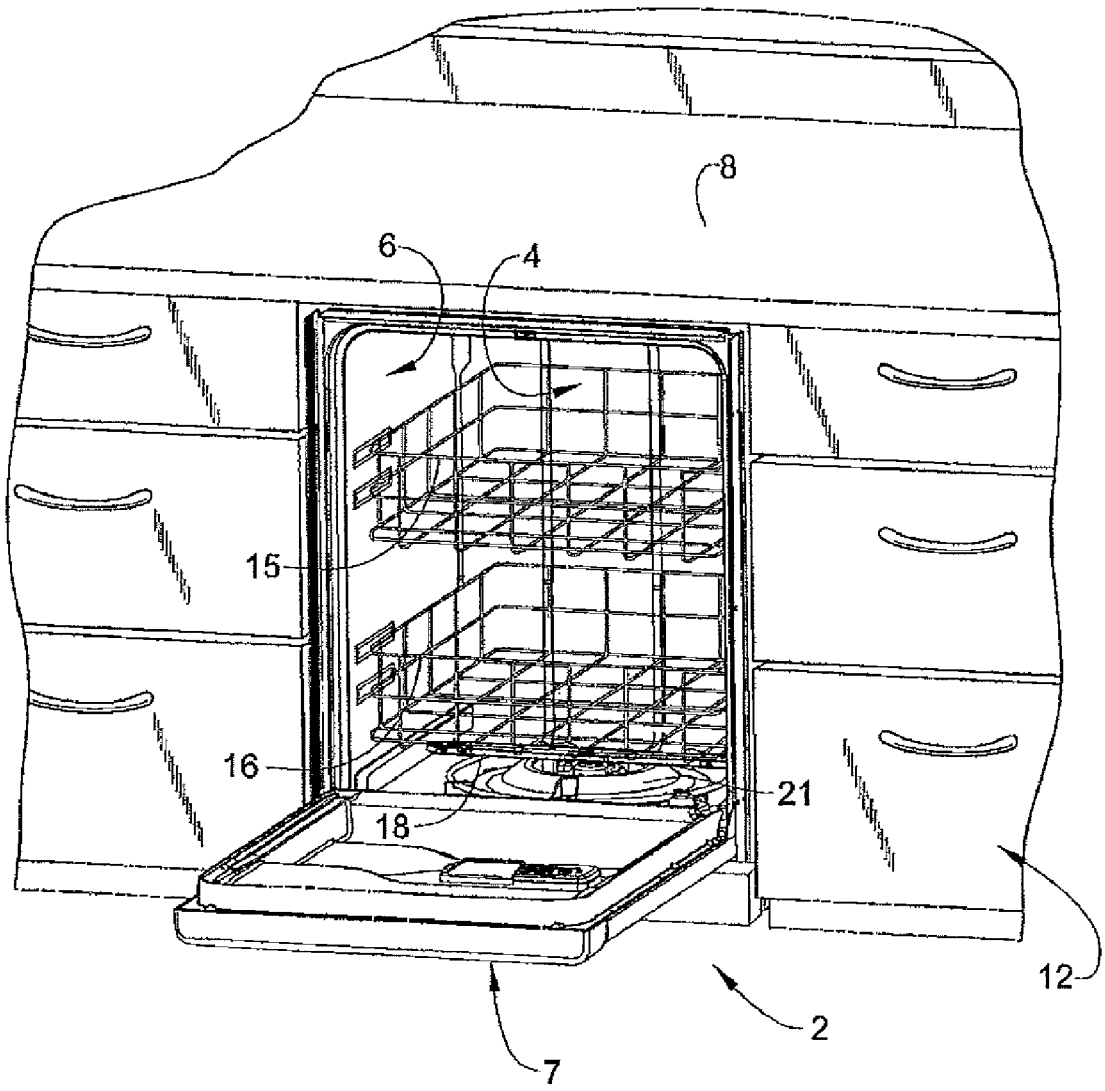
FIG. 1 is a right perspective view of a dishwasher including a tub formed from a multi-layered composite material constructed in accordance with the present invention.

With initial reference to FIG. 1, a dishwasher, constructed in accordance with the present invention, is generally indicated at 2. Dishwasher 2 is shown to include a washing chamber 4 defined by a tub 6. A door 7 is pivotally mounted to dishwasher 2 to selectively expose washing chamber 4 to enable a user to load and unload kitchenware. In the embodiment shown, dishwasher 2 is arranged below a countertop 8 adjacent cabinetry 12. In a manner known in the art, dishwasher 2 includes a plurality of dish racks 15 and 16 for supporting the kitchenware and a wash arm 18, fluidly connected to a pump 21, which sprays jets of washing fluid onto the kitchenware (not shown) during a washing operation.

Figure 2:
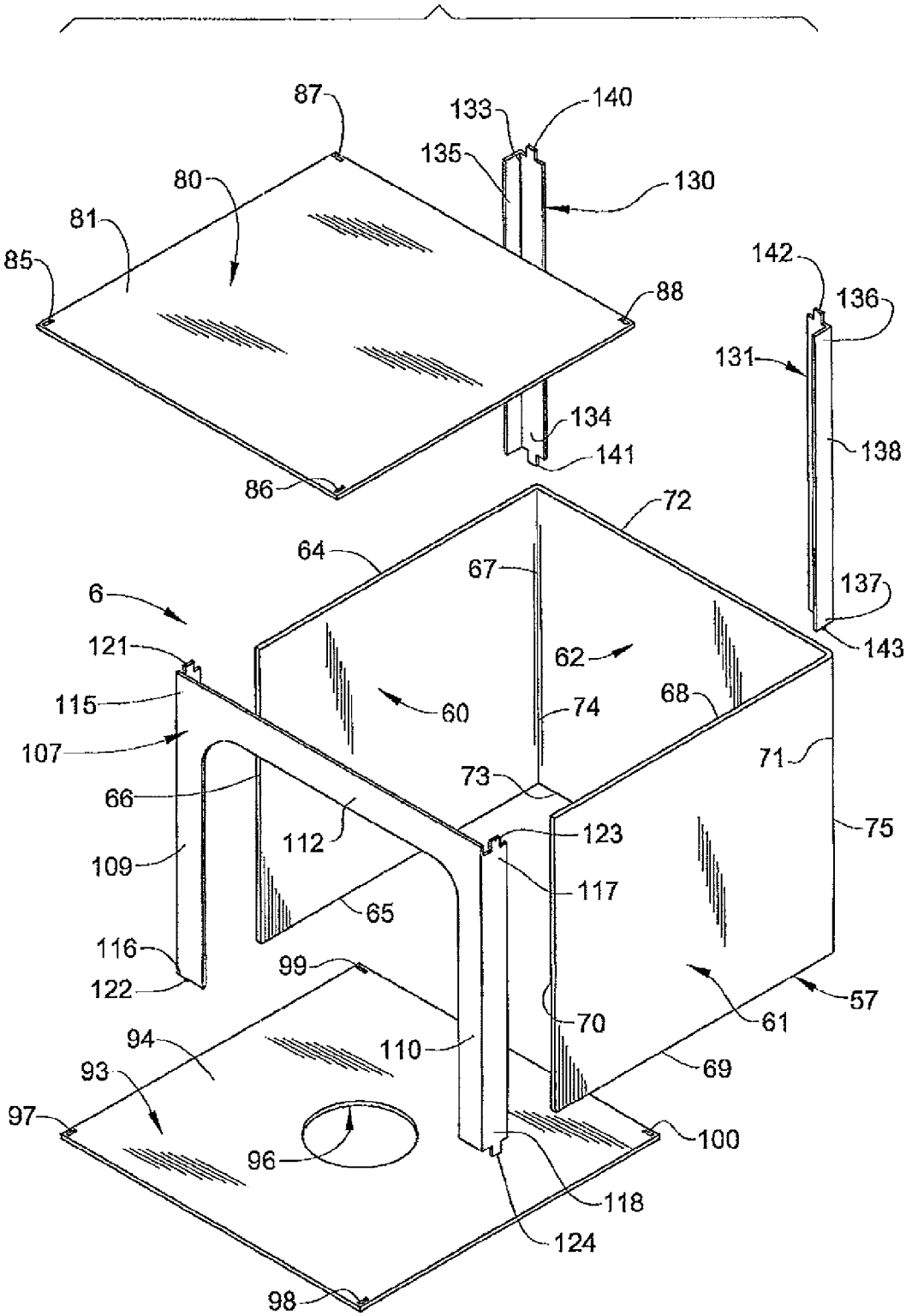
FIG. 2 is an exploded view of a dishwasher tub of the present invention.

In accordance with the invention, tub 6 is constructed from a multi-layered composite material as will be discussed more fully below. As best shown in FIG. 2, tub 6 includes a main body 57 having first and second opposing side walls 60 and 61 interconnected through a rear wall 62. First side wall 60 includes upper and lower edge portions 64 and 65 and outer edge portions 66 and 67. Likewise, second opposing side wall 61 includes upper and lower edge portions 68 and 69, as well as outer edge portions 70 and 71. Rear wall 62 includes upper and lower edge portions 72 and 73 and outer edge portions 74 and 75 that adjoin outer edge portions 67 and 71 of first and second opposing side walls 60 and 61 respectively.

Tub 6 further includes a top wall or cap member 80 which can be formed from stainless steel, plastic or a combination thereof depending upon the dishwasher model. Cap member 80 includes a generally rectangular horizontal planar portion 81 that is provided with a plurality of openings 85-88 at corner portions thereof. The purpose of openings 85-88 will be discussed more fully below. Tub 6 further includes a bottom wall or base member 93 which, in a manner similar to that described above, is preferably formed from stainless steel, plastic or a combination thereof. Base member 93 includes a generally horizontal planar portion 94 provided with a central opening 96 for receiving pump 21 and a plurality of openings 97-100 which align with openings 85-88 on cap member 80.

In accordance with the embodiment illustrated in FIG. 2, tub 6 further includes a door halo member 107 having first and second upstanding side members 109 and 110 that are interconnected by an upper cross member 112. Door halo member 107 provides a finished appearance for tub 6 while also serving as a sealing surface for door 7. In any event, first side member 109 includes first and second end opposing portions 115 and 116. Likewise, side member 110 includes first and second end opposing portions 117 and 118. Each end portion 115-118 includes a corresponding tab member 121-124 configured to be received by openings 85 and 86 on cap member 80 and openings 97 and 98 on base member 93. In addition to door halo member 107, tub 6 includes a pair of columns 130 and 131 arranged at a rear portion thereof. Columns 130 and 131 are preferably formed from a fiberglass reinforced material, most preferably from VERSAGLASS® sold by Owens Corning. The particular details of VERSAGLASS® can be found in commonly owned, co-pending U.S. patent application Ser. No. 10/099,659, entitled "Insulating Material", filed Mar. 15, 2002, which is incorporated by reference herein.

As shown, column 130 includes first and second opposing end portions 133 and 134 that are joined through an intermediate portion 135. Likewise, column 131 includes first and second opposing end portions 136 and 137 that are joined through an intermediate portion 138. Each column 130, 131 preferably has a generally L-shaped cross-section and, as will be discussed more fully below, designed to provide support along outer edge portions (not separately labeled) of tub 6. In addition, each end portion 133, 134 of column 130 and each end portion 136, 137 of column 131 is provided with a corresponding tab member 140-143 configured to be received by corresponding ones of openings 87 and 88 in cap member 80 and openings 99 and 100 in base member 93 as will be discussed more fully below.

Figure 3:
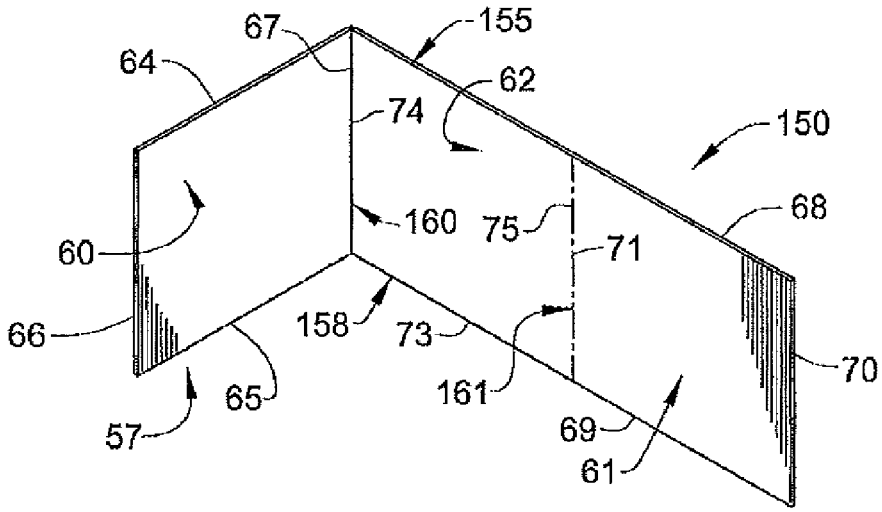
FIG. 3 is a perspective view of a main body portion of the dishwasher tub of FIG. 2.

In accordance with one aspect of the invention illustrated in FIG. 3, main body 57 can be formed from a single sheet 150 of multi-layered composite material, having upper and lower edge portions 155 and 158, that is bent along first and second fold lines 160 and 161 to create first and second opposing side walls 60 and 61 and rear wall 62. Preferably, fold lines 160 and 161 are established by creating notches (not shown) that extend between edge portions 155 and 158 on an outside surface (not separately labeled) of sheet 150. In this manner, no additional sealing is required between side walls 60 and 61 and rear wall 62. More specifically, after forming the notches in sheet 150, first side wall 60 is folded so as to extend substantially perpendicularly from rear wall 62. Next, second opposing side wall 61 is folded along fold line 161 so as to extend generally perpendicularly from rear wall 62, as well as parallel to side wall 60.

After forming main body 57, base member 93 is joined to lower edge portions 65, 69 and 73 of first and second side walls 60 and 61 and rear wall 62. Base member 93 is preferably secured to main body 57 through a crimping process. Of course, various welding techniques and/or adhesives could also be employed. At this point, door halo member 107 is positioned along and joined to outer edge portions 66 and 70 of first and second side walls 60 and 61 respectively, with tab members 122 and 124 being received by openings 97 and 98. Once properly positioned, door halo member 107 is joined to edge portions 66 and 70 through crimping, welding, adhesive or the like. Once door halo 107 is in position, tab members 141 and 143 of columns 130 and 131 are inserted into openings 99 and 100 respectively. Columns 130 and 131 are then flexed so as to provide a squeeze-fit type arrangement along the outer edge portions 74 and 75 of tub 6. Once door halo member 107 and columns 130 and 131 are properly positioned, cap member 80 is joined to upper edge portions 64, 68 and 72 of first and second opposing side walls 60 and 61 and rear wall 62. More specifically, openings 85 and 86 are aligned with corresponding ones of tab members 121 and 123 and openings 87 and 88 are aligned with respective ones of tab members 140 and 142. Once properly aligned, cap member 80 is seated upon upper edge portions 64, 68 and 72 and joined to side walls 60 and 61, along with rear wall 62, in a manner similar to that described above with respect to base member 93. Once completed, tub 6 is integrated into dishwasher 2 during final assembly.

Figure 4:
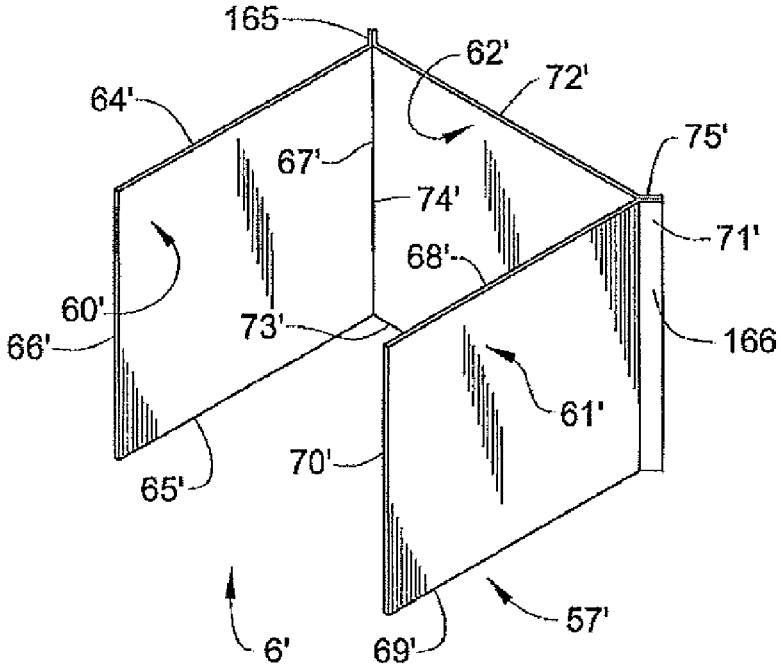
FIG. 4 is a perspective view of a main body portion of the dishwasher tub constructed in accordance with another embodiment of the present invention.

In accordance with another embodiment of the invention as illustrated in FIG. 4, a tub 6' is formed from a plurality of distinct sheets of multi-layered composite material. More specifically, first and second opposing side walls 60' and 61' are joined to a rear wall 62'. In a manner similar to that described above, first side wall 60' includes upper and lower edge portions 64' and 65', as well as first and second opposing outer edge portions 66' and 67'. Likewise, side wall 61' includes upper and lower edge portions 68' and 69', as well as opposing outer edge portions 70' and 71'. Rear wall 62' includes upper and lower edge portions 72' and 73' and opposing outer edge portions 74' and 75'. With this construction, outer edge portion 67' of side wall 61' is joined to outer edge portion 74' of rear wall 62' through a crimping process to form a joint 165. Likewise, outer edge portion 71' of side wall 61' is joined to outer edge portion 75' of rear wall 62' to form a join 166 in a similar manner to form a main body 57'. At this point, tub 6 is constructed substantially similarly to that described above with cap member 80 being joined to upper edge portions 64', 68' and 72', and base member 93 being connected to lower edge portions 65', 69' and 73'. Door halo member 107 and columns 130 and 131 are also connected in a manner similar to that described above.

Figure 5:
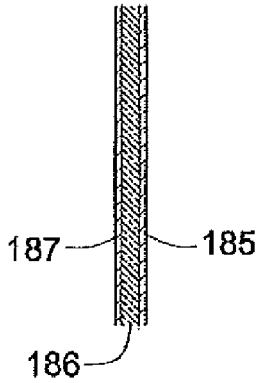
FIG. 5 is a cross-sectional side view of the multi-layered composite material of the present invention.

As noted above, tub 6 is formed from a multi-layered composite material. As best shown in FIG. 5, the multi-layered composite material includes a first or inner layer 185, a second or intermediate layer 186 and a third or outer layer 187. Inner layer 185 is preferably formed from thin (approx. 0.05-0.08 inch; 1.27-2.03 mm) gauge stainless steel and represents an interior surface of tub 6. Intermediate layer 2 is preferably a polyester fiber reinforced mat, such as VERSAMAT® made by Owens Corning, which provides both structural support and sound insulation for dishwasher 2. The particular details of VERSAMAT® can be found in commonly owned, co-pending U.S. patent application Ser. No. 10/099,659, entitled "Insulating Material", filed Mar. 15, 2002, which is incorporated by reference herein.

Third layer 187 defines a protective layer for tub 6 and is preferably formed from hard plastic, aluminum foil or the like. With this construction, the multi-layered composite material minimizes thermal loss from tub 6 thereby eliminating the need for any additional insulation layers or sound deadening blankets about dishwasher 2. In addition, the multi-layered composite material provides structural reinforcement to tub 6 thereby eliminating the need for additional reinforcing members such as ribs, frames and the like. Moreover, the use of columns 130 and 131 and door halo 107 further add to the overall structural integrity of the dishwasher. Columns 130 and 131 and door halo 107 also provide protection to vulnerable portions of dishwasher 2 thereby eliminating the need for shipping containers which totally encapsulate the dishwasher. It should also be understood that the present invention provides a modular, cost-efficient component for dishwashers which can be constructed in various locations and readily transported to a central location for final assembly and shipment to wholesalers, consumers, etc. The multi-layered composite material also eliminates the need for expensive stamping machinery and reduces the number of welding and crimping operations required to produce a dishwasher tub. Finally, the multi-layered composite material can be formed in a variety of shapes so as to accommodate various dishwasher models. In this manner, there would be no need to halt production, retool and start another production line for a different dishwasher model. Thus, the present invention enables a manufacturer to produce short production runs of dishwasher tubs in a time and cost efficient manner.

Although described with reference to preferred embodiments of the invention, it should be readily understood that various changes and/or modifications can be made to the invention without departing from the spirit thereof.

We claim:

1. A dishwasher tub comprising:

a main body having first and second opposing side walls interconnected by a rear wall, each of said first and second opposing side walls and rear wall including corresponding upper and lower edge portions and being formed from a multi-layered composite material;

first and second columns positioned at rear edge portions of the main body, wherein each of the first and second columns are formed from a fiber reinforced material;

a cap member joined to the upper edge portion of each of the first and second opposing side walls and the rear wall, wherein the cap member includes first and second apertures formed therein, and each of the first and second columns includes a tab member received in a respective one of the first and second apertures; and a base member joined to the lower edge portion of each of the first and second opposing side walls and the rear wall.

2. The dishwasher tub according to claim 1, wherein the multi-layered composite material includes an inner stainless layer, an intermediate layer and an outer protective layer.

3. The dishwasher tub according to claim 2, wherein the inner stainless layer is stainless steel and the intermediate layer is a fiber reinforced mat.

4. The dishwasher tub according to claim 3, wherein the mat is reinforced with a polyester fiber.

5. The dishwasher tub according to claim 3, wherein the outer layer is hard plastic.

6. The dishwasher tub according to claim 3, wherein the outer layer is aluminum foil.

7. The dishwasher tub according to claim 1, wherein each of the cap member and the base member is formed, at least in part, from stainless steel.

8. The dishwasher tub according to claim 7, wherein the cap member is also formed, at least in part, from plastic.

9. The dishwasher tub according to claim 1, wherein the fiber reinforced material is reinforced with a glass fiber.

10. The dishwasher tub according to claim 1, further comprising: a door halo member positioned along front edge portions of the main body.

11. The dishwasher tub according to claim 1, further comprising: a door halo member positioned along front edge portions of the main body, the door halo including first and second upstanding side members interconnected by an upper cross member, each of the first and second upstanding side members including a tab member received in respective third and fourth apertures formed in the cap member.

* * * * *